US006939252B1

(12) United States Patent
Stanczak et al.

(10) Patent No.: US 6,939,252 B1
(45) **Date of Patent: *Sep. 6, 2005**

(54) GOLF BALL WITH THREE DIMPLE TYPES

(75) Inventors: Matthew B. Stanczak, Westminster, SC (US); Lane D. Lemons, Jackson, TN (US)

(73) Assignee: Dunlop Sports Group Americas INC, Westminster, SC (US)

( * ) Notice: Subject to any disclaimer, the term of this patent is extended or adjusted under 35 U.S.C. 154(b) by 77 days.

This patent is subject to a terminal disclaimer.

(21) Appl. No.: 09/979,833

(22) PCT Filed: Jun. 5, 2000

(86) PCT No.: PCT/US00/40067

§ 371 (c)(1),
(2), (4) Date: Nov. 27, 2001

(87) PCT Pub. No.: WO00/74797

PCT Pub. Date: Dec. 14, 2000

Related U.S. Application Data

(60) Provisional application No. 60/138,078, filed on Jun. 8, 1999.

(51) Int. Cl.[7] ..... A63B 37/12
(52) U.S. Cl. ..... 473/383; 473/378
(58) Field of Search ..... 473/378–385

(56) References Cited

U.S. PATENT DOCUMENTS

| | | | | |
|---|---|---|---|---|
| 4,762,326 | A | 8/1988 | Gobush | |
| 4,840,381 | A * | 6/1989 | Ihara et al. | 473/365 |
| 4,844,472 | A * | 7/1989 | Ihara | 473/379 |
| 4,932,664 | A | 6/1990 | Pocklington | |
| 5,018,741 | A | 5/1991 | Stiefel et al. | |
| 5,064,199 | A | 11/1991 | Morell | |
| 5,092,604 | A | 3/1992 | Oka | |
| 5,143,377 | A * | 9/1992 | Oka et al. | 473/383 |
| 5,253,872 | A * | 10/1993 | Lemons et al. | 473/384 |

* cited by examiner

*Primary Examiner*—Raeann Gorden
(74) *Attorney, Agent, or Firm*—Lorusso & Loud; Jeffrey D. Washville; Marc A. Vivenzio

(57) ABSTRACT

The present invention provides a golf ball having a plurality of dimples arranged on its outer surface, selected from two sets of dimples, the first set having a single radius cross section and the second set having a dual radius cross section. The dimples are arranged on the surface of the ball according to the rhombicosadodecahedron.

26 Claims, 17 Drawing Sheets

GOLF BALL WITH THREE DIMPLE TYPES

This application claims the benefit of provisional application No. 60/138,078 filed Jun. 8,1999.

BACKGROUND OF THE INVENTION

This invention relates to golf balls and more particularly to a surface configuration of a golf ball.

DESCRIPTION OF THE PRIOR ART

For many years golf balls have been made with surface indentations or depressions, called dimples, to improve their aerodynamic properties in flight. Many efforts have been made to select the optimum number, size and shape of dimples as well as their disposition around the outer surface of a generally spherically shaped golf ball.

Dimples on golf balls are typically circular in elevation cross section, but a number of other designs are also utilized, including truncated cones, dimples within dimples, elliptical surfaces, hemispherical (or single radius) dimples, and dual radius dimples. For example, U.S. Pat. No. 4,979,747 shows dimples having a frusto-contical elevation view cross section, and U.S. Pat. No. 5,005,838 shows dimples having complex shapes.

Different dimple shapes have different aerodynamic properties, and therefore, result in different performance characteristics. For example, a single radius dimple provides a more gradual entry of the airflow into the dimple, while a dual radius dimple provides a more abrupt entry of the airflow into the dimple. (A single radius dimple is one in which the elevation cross sectional shape of the dimple can be described by one radius, and dual radius dimple is one in which the elevation cross section is described by two radii.)

It has been found that the single radius dimple is the most optimal dimple shape for a high performance three-piece wound golf ball. By contrast, the dual radius dimple is the most optimal shape design for two-piece distance balls for providing the desired golf ball flight trajectory. These dimple choices are based on the current view that the higher spinning performance balls require a more gradual entry of the airflow into the dimple to create the desired aerodynamic effects, whereas the low spinning distance ball requires a more abrupt entry of the airflow into the dimple to create the desired aerodynamic effect.

There are a number of hybrid type balls which do not fall squarely within either the three-piece performance category or the two-piece distance category. For example, two-piece performance balls and three-piece distance balls are hybrid balls which behave like performance balls for certain shots and like distance balls for other shots. As used herein the term "hybrid ball" is used to refer to a two piece performance ball, a three-piece distance ball, or any other ball which behaves like a performance ball for certain shots and like a distance ball for other shots.

It has been found, for instance that a dimple pattern utilizing dual radius dimples allows for a lower more boring trajectory for a distance two-piece ball, whereas a pattern utilizing single radius dimples allows for a more consistent flight trajectory for high performance three-piece balls.

A need exists for a dimple pattern (and dimple shape) which takes into account the unique characteristics of the hybrid ball (i.e. the fact that it performs as a distance ball for certain shots, and as a performance ball for other shots) to provide optimum performance. The goal is to provide a ball that (i) provides slightly longer overall distance than a ball utilizing either all single radius dimples or all dual radius dimples, and (ii) has a significantly lower trajectory, as exhibited by the lower rear trajectory value.

Thus, it is an object of the present invention to provide a golf ball dimple pattern that optimizes the performance characteristics of the hybrid ball.

It is another object of the present invention to provide a hybrid golf ball that provides a slightly longer overall distance and a lower trajectory than the prior art hybrid balls.

It is another object of the invention to provide a golf ball having a dimple pattern that incorporates dimples of different sizes to maximize the aerodynamic qualities for each such dimple shape.

It is yet another object of the present invention to provide a golf ball having superior distance, trajectory and flight stability.

SUMMARY OF THE INVENTION

These and other objectives of the present invention are accomplished according to the present invention by providing a golf ball having a dimple pattern which incorporates dimples of different shapes to maximize the aerodynamic properties of the ball. The dimple shapes may be selected from any known dimple shapes, including but not limited to truncated cones, squares, triangles, dimples within dimples, elliptical surfaces, single radius dimples, and dual radius dimples. The invention allows for the combination of any of the possible dimple shapes into a single dimple pattern to allow a more optimized golf ball flight trajectory.

The golf ball of the preferred embodiment is a hybrid ball in which the dimple pattern on the surface of the ball includes both single radius and dual radius dimples in order to achieve the most optimal flight performance. This hybrid ball is allowed to best utilize the aspects of single radius dimples for shots where it behaves more like a performance three-piece ball, and the aspects of dual radius dimples for shots where it behaves like a distance ball, while maintaining good flight performance and control with a combination of both. The ball provides slightly longer overall distance, and a significantly lower trajectory than the prior art hybrid balls. This is a much desired property for this type of ball.

The dimples are arranged by dividing the outer spherical surface of a golf ball into a plurality of polygonal configurations, including pentagons, squares and triangles for locating a plurality of dimples on the outer surface of the golf ball. The polygonal configurations of this invention are preferably a combination of regular pentagons, squares and triangles to cover the outer surface. This first plurality of polygonal configurations is generally referred to herein as a "rhombicosadodecahedron". The rhombicosadodecahedron is further characterized by a uniform pattern of pentagons formed over the outer surface each bounded by triangles and squares.

The preferred embodiment utilizes a pattern of 402 dimples arranged in the construction of the rhombicosadodecahedron. A pair of first polygonal configurations, each located on opposite sides of the outer surface, include one of the two poles symmetrically arranged within its boundaries. The outer surface has a plurality of dimples of different sizes. In one embodiment, the dimples are of first, second and third sizes and are generally located to have a first pattern associated with the pentagons, a second pattern associated with the squares, and a third pattern associated with the triangles.

In another embodiment of the invention, the outer surface of the golf ball includes a plurality of parting lines along great circle paths of the ball for further dividing the first plurality of polygonal configurations into a second plurality of polygonal configurations, each of which are smaller than the polygonal configurations of the first polygonal configurations. The dimples are arranged over the outer surface by being associated with both the first and the second plurality of polygonal configurations.

DESCRIPTION OF THE DRAWINGS

The invention will be more readily understood from a reading of the following specification and by reference to the accompanying drawings forming a part thereof, wherein an example of the invention is shown and wherein.

DESCRIPTION OF THE PREFERRED EMBODIMENT

Referring now in more detail to the drawings, the invention will now be described in more detail. The golf ball 5 may have a unit construction in a single piece, molded from a suitable rubber or plastic composition; it may be of a two-piece ball construction having a separately applied cover applied around a core; it may be of a three piece wound ball with a liquid or solid center; or it may be a multipiece solid golf ball. The cover is molded from a material suitable for golf balls. It may be molded as two separate hemispherical half-shells which are then compression molded or injection molded around the core.

The dimple configuration will normally be applied to the ball during the molding of the cover around the core by using appropriately shaped negative molds containing the dimple pattern in reverse. The molded golf ball having the desired dimple configuration may be then painted. Alternately, painting may be unnecessary for one piece golf balls using a cover having a suitable compounding of the composition used.

Accordingly, the scope of this invention provides a golf ball mold whose molding surface contains a uniform pattern to give the golf ball a dimple configuration superior to those of the prior art. The invention is preferably described in terms of the golf ball that results from the mold, but could be described within the scope of this invention in terms of the mold structure that produces a golf ball.

Figure 1:
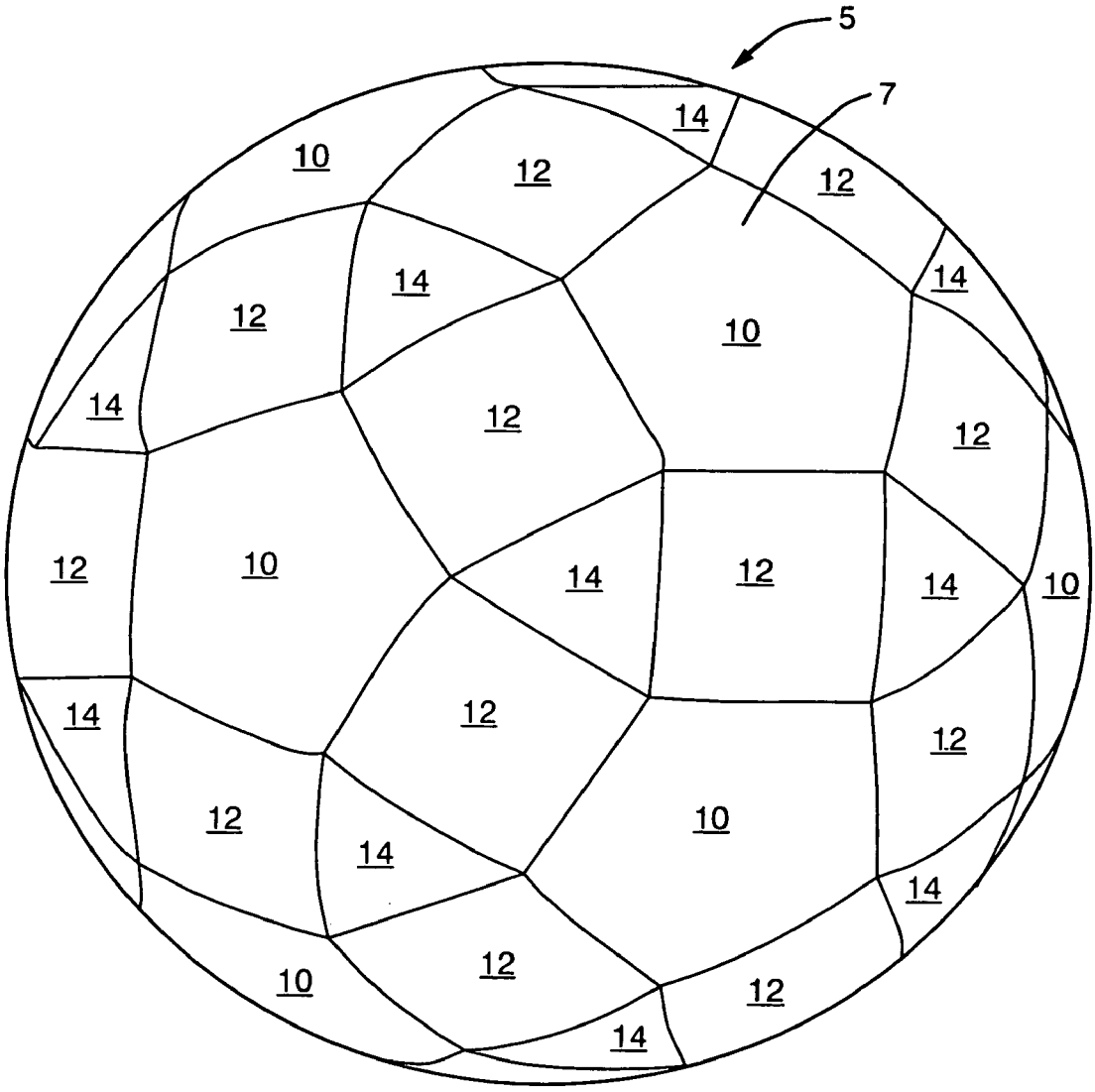
FIG. 1 is an elevation view of the outer surface of a golf ball being divided into a plurality of polygonal configurations according to the invention.

To assist in locating the dimples on the golf ball, the golf ball 5 of this invention has its outer spherical surface partitioned by the projection of a plurality of polygonal configurations onto the outer surface. That is, the formation or division that results from a particular arrangement of different polygons on the outer surface of a golf ball is referred to herein as a "plurality of polygonal configurations." A view of one side of a golf ball 5 showing a preferred division of the golf ball's outer surface 7 is illustrated in FIG. 1.

In the preferred embodiment, a polygonal configuration known as a rhombicosadodecahedron is projected onto the surface of a sphere. A rhombicosadodecahedron is a type of polyhedron which contains thirty (30) squares, twenty (20) polyhedra of one type, and twelve (12) polyhedra of another type. The term "rhombicosadodecahedron" is derived from "dodecahedron," meaning a twelve (12) sided polyhedron; "icosahedron," meaning a twenty (20) sided polyhedron, and "rhombus" meaning a four sided polyhedron.

The rhombicosadodecahedron of the preferred embodiment is comprised of thirty (30) squares 12, twelve (12) pentagons 10, and twenty (20) triangles 14. It has a uniform pattern of pentagons with each pentagon bounded by triangles and squares. The uniform pattern is achieved when each regular pentagon 10 has only regular squares 12 adjacent to its five boundary lines, and when a regular triangle 14 extends from each of the five vertices of the pentagon. Five (5) squares 12 and five (5) triangles 14 form a set of polygons around each pentagon. Two boundary lines of each square are common with two pentagon boundary lines, and each triangle has its vertices common with three pentagon vertices.

The outer surface of the ball is further defined by a pair of poles and an equatorial great circle path around the surface. A great circle path is defined by the intersection between the spherical surface and a plane which passes through the center of the sphere. An infinite number of great circle paths may be drawn on any sphere. The equatorial great circle path in the preferred embodiment corresponds to a mold parting line which separates the golf ball into two hemispheres. The mold parting line is located from the poles in substantially the same manner as the equator of the Earth is located from the North Pole and the South Pole.

Figure 2:
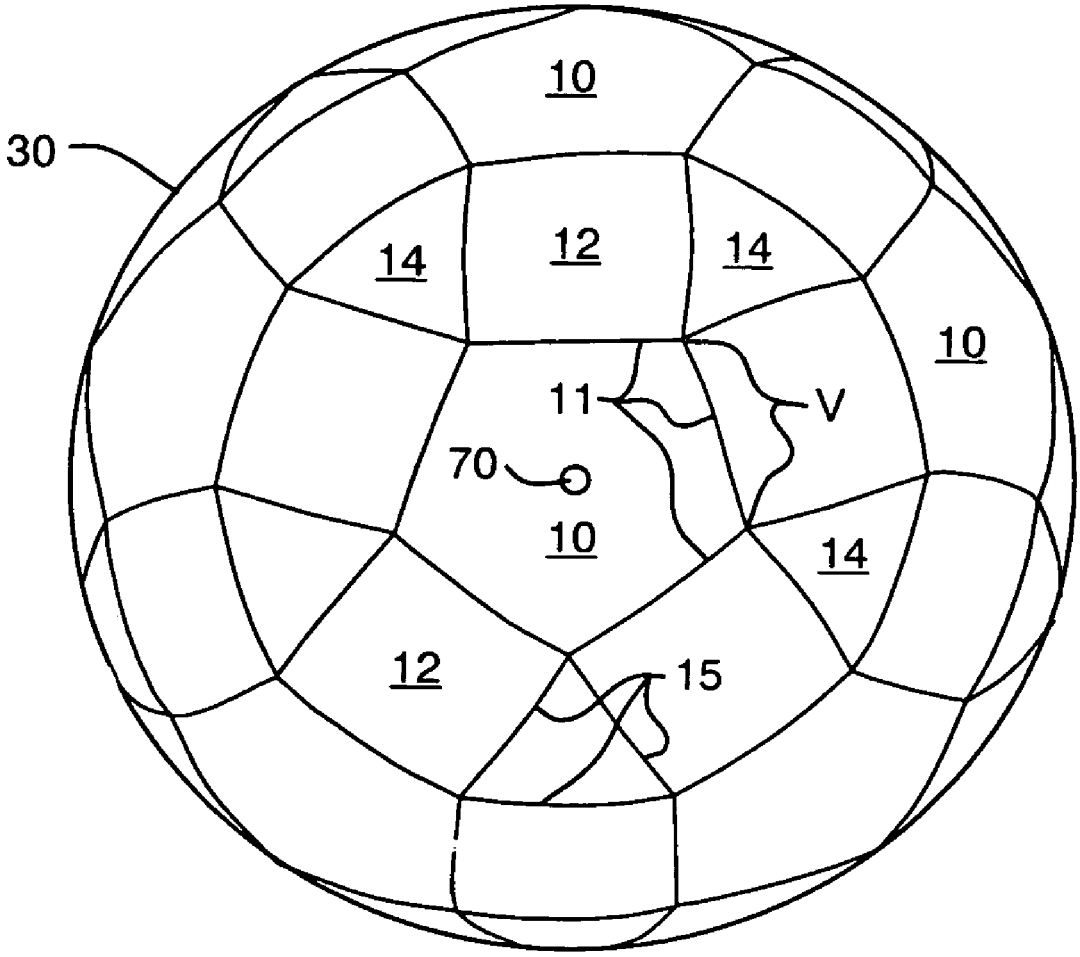
FIG. 2 is an elevation view of the golf ball of this invention showing the relative locations of pentagons, squares and triangles formed on the outer surface with a pole at the center of a pentagon.

Referring to FIG. 2, the poles 70 are located at the center of a pentagon 10 on the top and bottom sides of the ball, as illustrated in this view of one such side. The mold parting line 30 is at the outer edge of the circle in this planar view of the golf ball. In the embodiment shown in FIG. 3, the poles 72 are both located at the center of the square on the top and bottom of the golf ball, as illustrated in this view of one such side. (The top and bottom views are identical.) The mold parting line 40 is at the outer edge of the circle in this planar view of the golf ball.

Dimples are placed on the outer surface of the golf ball based on segments of the plurality of polygonal configurations described above. In the preferred embodiment, three (3) dimples are associated with each triangle, five (5) dimples are associated with each square, and sixteen (16) dimples are associated with each pentagon. The term "associated" as used herein in relation to the dimples and the polyhedra means that the polyhedra are used as a guide for placing the dimples.

The dimple configuration of the preferred embodiment is shown in FIGS. 4–7. It is based on the projection of the rhombicosadodecahedron shown in FIG. 2. The ball has a total of 402 dimples. The plurality of dimples on the surface of the ball are selected from three sets of dimples, with each set having different sized dimples. Dimples 200 are in the first set, dimples 202 are in the second set, and dimples 204 are in the third set. Dimples are selected from all three sets to form a first pattern associated with the pentagon 10. All sides 206 of each pentagon are intersected by two dimples 200 from the first set of dimples and one dimple 202 from the second set of dimples. All pentagons 10 have the same general first pattern arrangement of dimples.

Dimples 200, 202 and 204 (from all three sets of dimples) are also used to form a second pattern associated with the squares 12. All sides 208 of each square 12 are intersected by dimples 202 from the second set of dimples, and all squares have the same general second pattern arrangement of dimples.

Dimples 202 from the second set of dimples form a third pattern associated with the triangles 14. All sides 210 of each triangle are intersected by a dimple 202 from this second set of dimples. All triangles have this same general third pattern arrangement of dimples. The mold parting line 30 is the only dimple free great circle path on this ball.

Figure 18:
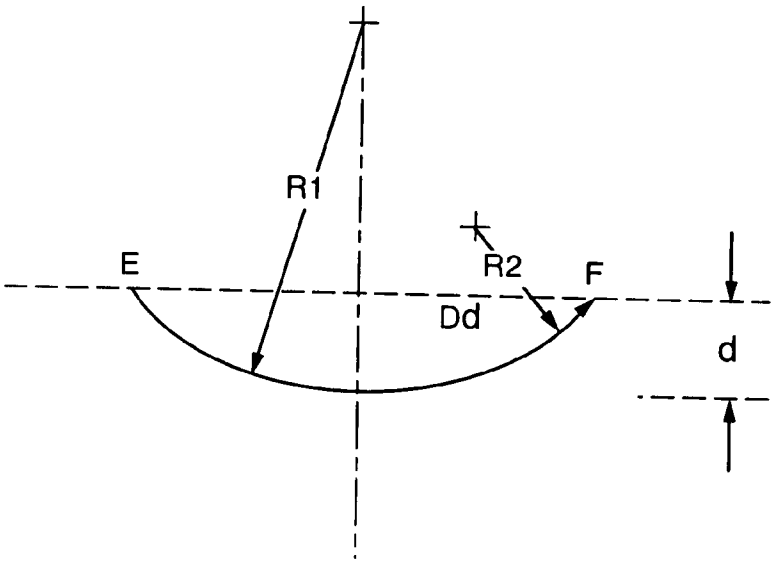
FIG. 18 is a cross sectional view of a dual radius dimple.
Figure 17:
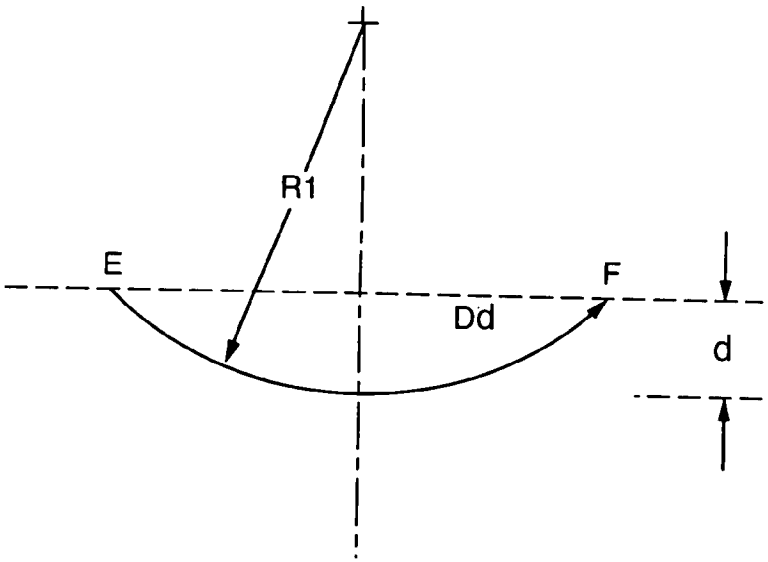
FIG. 17 is a cross sectional view of a single radius dimple.

The ball of the preferred embodiment utilizes two different types of dimples having two different cross sections, single radius dimples 200 and 204 and dual radius dimples 202. In the single radius dimple (FIG. 17), a single radius (referred to as a major radius, or Radius 1) describes the shape of the bottom of the dimple. In other words, the major radius governs the shape of the dimple toward the bottom of the dimple. In a dual radius dimple, (FIG. 18), on the other hand, two radii are used to describe the shape of the dimple. The major radius describes the bottom of the dimple, and a minor radius (Radius 2) describes the shape of the dimple about its circumference.

Figure 16:
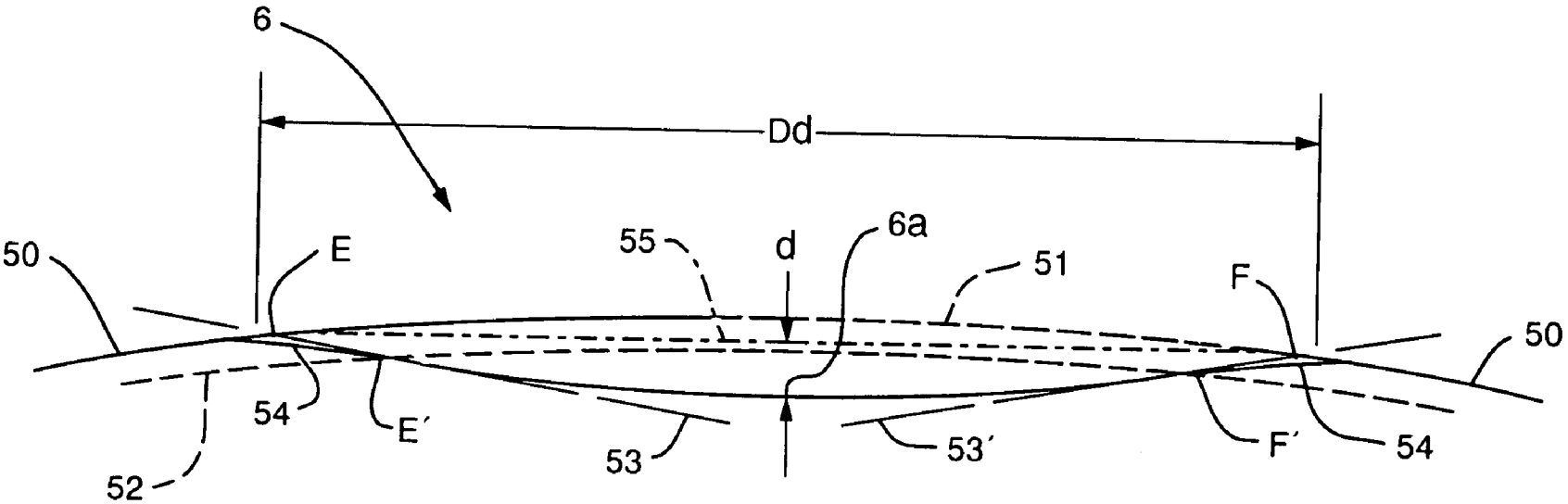
FIG. 16 is a cross sectional view cut through one of the dimples on the outer surface of the ball.

Dimple size is measured by a diameter and depth generally according to the teachings of U.S. Pat. No. 4,936,587 (the '587 patent), which is included herein by reference thereto. An exception to the teaching of the '587 patent is the measurement of the depth, which is discussed below. A cross-sectional view through a typical single radius dimple 6 is illustrated in FIG. 16. The diameter Dd used herein is defined as the distance from edge E to edge F of the dimple. Edges are constructed in this cross-sectional view of the dimple by having a periphery 50 and a continuation thereof 51 of the dimple 6. The periphery and its continuation are substantially a smooth surface of a sphere. An arc 52 is inset about 0.003 inches below curve 50-51-50 and intersects the dimple at point E' and F'. Tangents 53 and 53' are tangent to the dimple 6 at points E' and F' respectively and intersect periphery continuation 51 at edges E and F respectively. The exception to the teaching of '587 noted above is that the depth d is defined herein to be the distance from the chord 55 between edges E an F of the dimple 6 to the deepest part of the dimple cross sectional surface 6 (a), rather than a continuation of the periphery 51 of an outer surface 50 of the golf ball.

The dimple dimensions for the preferred embodiment are set forth below:

| Dimple(number) | Diameter(in) | Type | Radius 1(in) | Radius 2(in) |
|---|---|---|---|---|
| 200 (60) | .156 | Single | .4148 | NA |
| 202(150) | .145 | Dual | .7874 | .1181 |
| 204(192) | .140 | Single | 3535 | NA |

It is understood that the following dimple size ranges are within the scope of this invention: dimples 200 from the first set may have a diameter in the range of 0.150 inches to 0.160 inches; dimples 202 from the second set may have a diameter in the range of 0.140 inches to 0.150 inches; dimples 204 from the third set may have a diameter in the range of 0.135 inches to 0.145 inches; all dimples, 200, 202 and 204 may have a depth in the range of 0.0056 inches to 0.0078 inches; the major radius may be in the range of 0.34 inches to 0.80 inches; and the minor radius (for dimple 202) may be in the range of 0.10 inches to 0.12 inches.

The following test data illustrates the improved performance of the dimple pattern of the present invention. All balls identified below are hybrids

| BALL | # DIMPLES | PATTERN | CARRY (YDS) | TOTAL (YDS) | TRAJECTORY |
|---|---|---|---|---|---|
| BB344 | 402 | single radius | 247.8 | 268.0 | 8.4 |
| BB351 | 402 | dual radius | 246.3 | 268.2 | 8.2 |
| BB370 | 402 | Combined | 246.6 | 270.0 | 8.2 |
| Control | 392 | single radius | 245.6 | 267.5 | 8.3 |

As shown above, the ball of the present invention, which utilizes both single radius and dual radius dimples, provides slightly longer overall distance than a ball utilizing either all single radius dimples or all dual radius dimples, and it has a significantly lower trajectory, as exhibited by the lower rear trajectory value. This is a much desired property for the hybrid ball.

Figure 8:
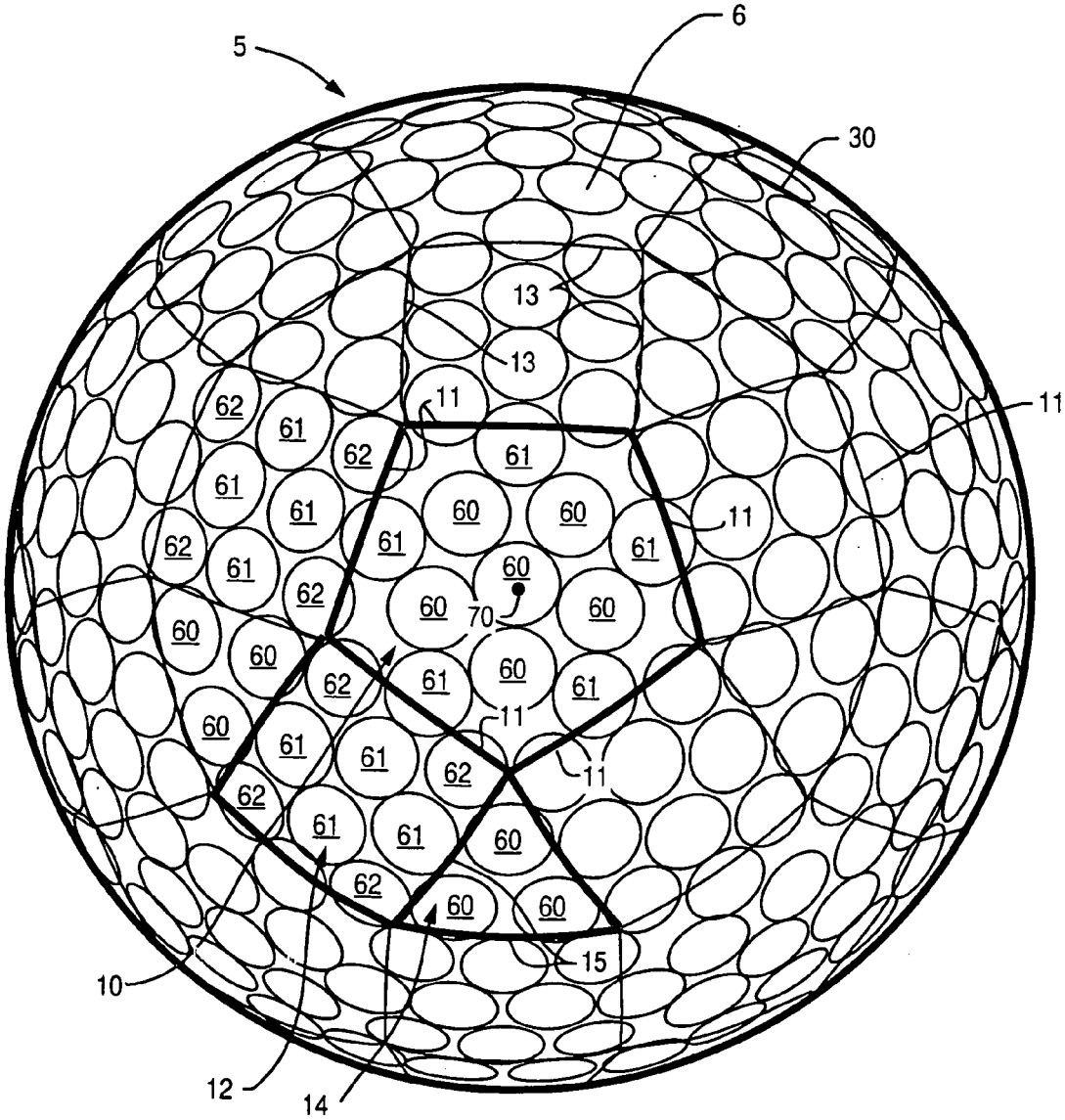
FIG. 8 is an elevation view of the golf ball showing circular dimples of three sizes being located on the outer surface of the golf ball to correspond with the polygonal configurations of FIG. 2.
Figure 9:
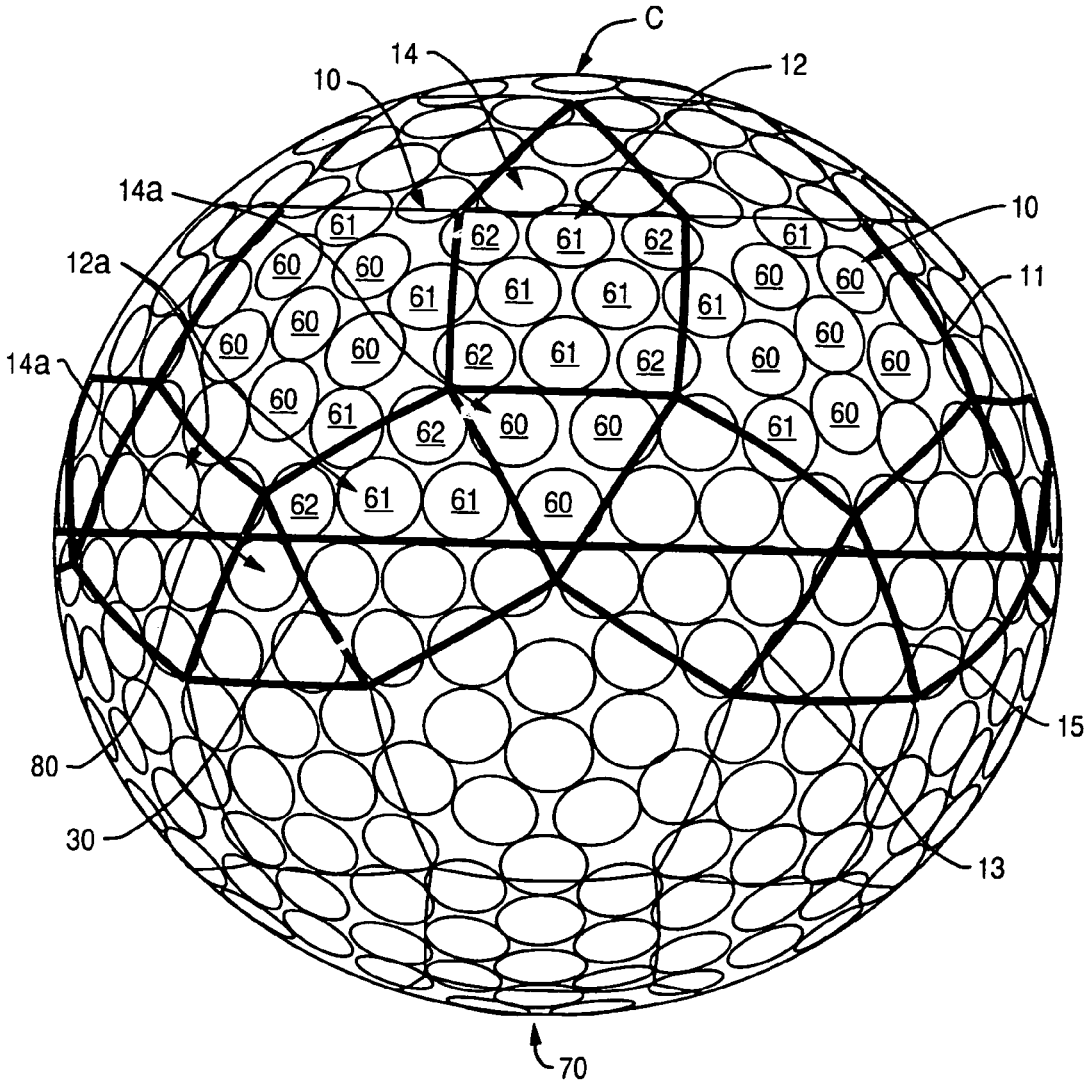
FIG. 9 is a elevation view of the golf ball of FIG. 4 rotated to show an equatorial great circle path defining a mold line.

FIG. 8 shows another embodiment of the present invention. The dimples are arranged on the surface of the ball based on the projection of the rhombicosadodecahedron as shown in FIG. 2. The poles are located at the center of the pentagons on the top and bottom of the balls (FIG. 8). The mold parting (30) line is the only great circle path on the ball that is not intersected by a dimple. A rotated view of the ball shown in FIG. 8 is shown in FIG. 9. A mold parting surface 80 adjacent the mold parting line 30 is formed by defining a great circle path void of dimples. The mold parting line 30 runs through certain of the squares 12*a* and triangles 14*a* projected onto the surface. The dimples adjacent the mold line 30 help to form boundaries of the mold parting surface. The plurality of dimples on the surface of the ball shown in FIG. 8 are selected from three sets of dimple of three different sizes. Dimples 60 are from a first set of dimples, dimples 61 are from a second set, and dimples are 62 from a third set. Dimples 60 and 62 form a first pattern associated with the pentagons 10. All sides 11 of each pentagon 10 are intersected by dimples 61 from the second set and all pentagons 10 have the same general first pattern of dimples. All sides 13 of each square 12 are intersected by third dimples 62, and all squares 12 have the same general second pattern arrangement of dimples. The first dimples 60 form a third pattern associated with the triangles 14. All sides 15 of each triangle 14 are intersected by first dimples 60 and all triangles have the same general third pattern arrangement of dimples. In this embodiment, the dimples 60 are larger than the dimples 61, which in turn, are larger than the dimples 62. The sizes of the dimples 60, 61, and 62 correspond to the sizes of the dimples 200, 202, and 204, respectively, as described above.

Figure 3:
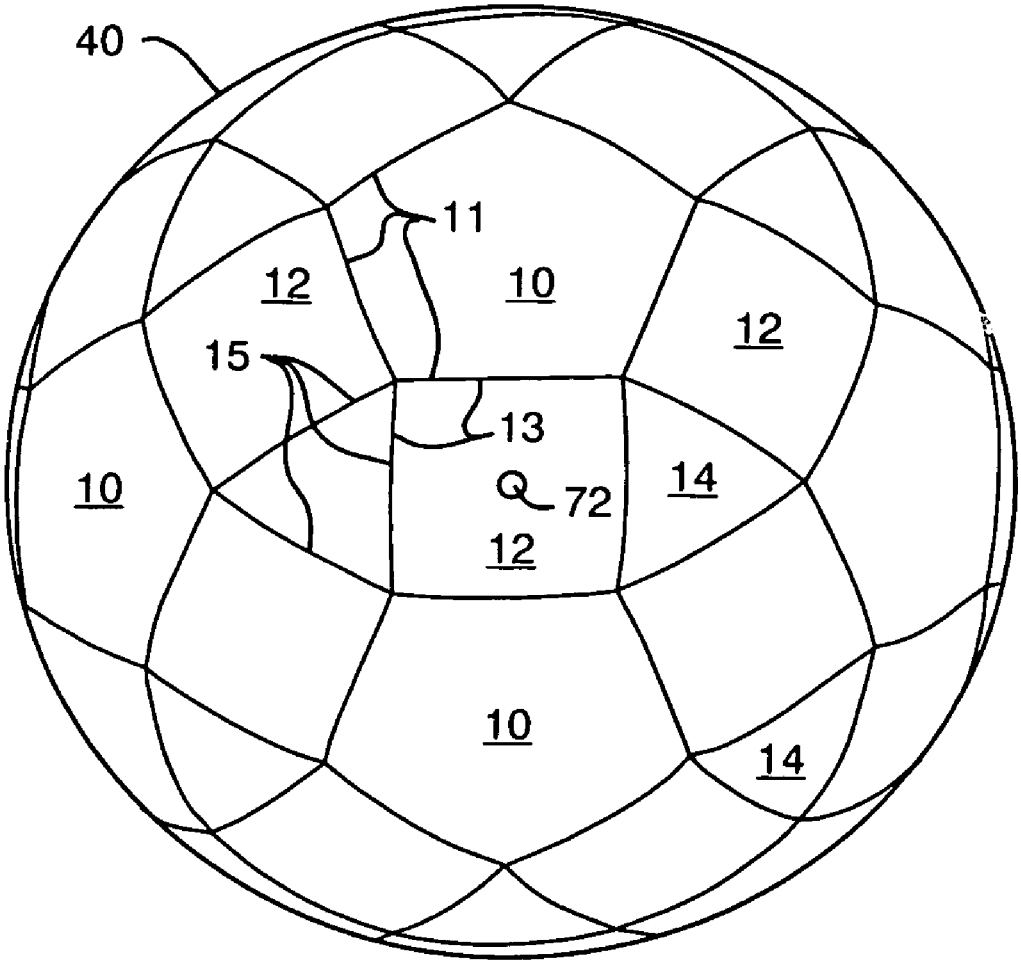
FIG. 3 is an elevation view of the golf ball of this invention showing the relative locations of pentagons, squares and triangles formed on the outer surface with a pole at the center of a square.
Figure 4:
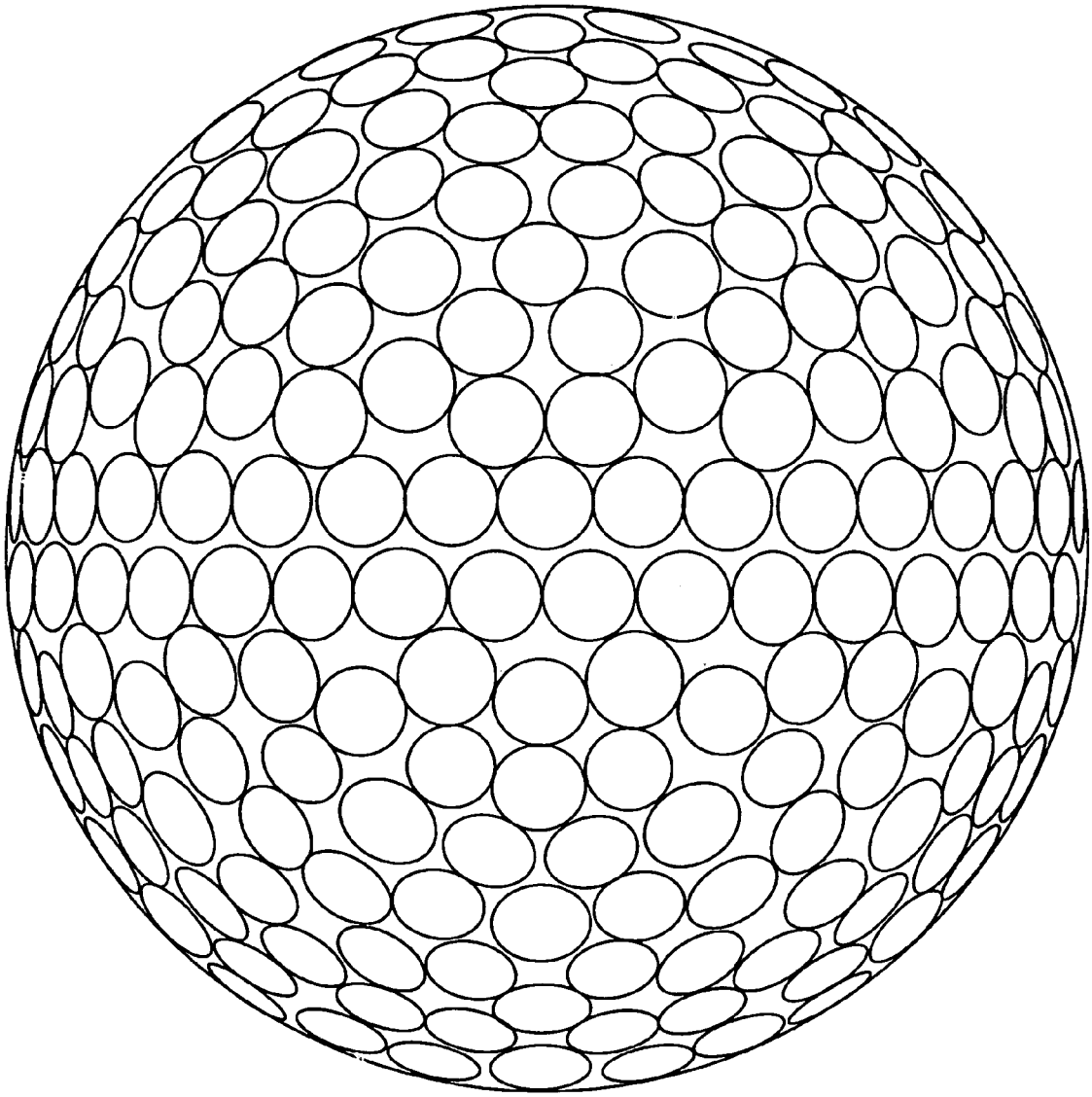
FIG. 4 is an equatorial view of the ball of preferred embodiment of the present invention.
Figure 5:
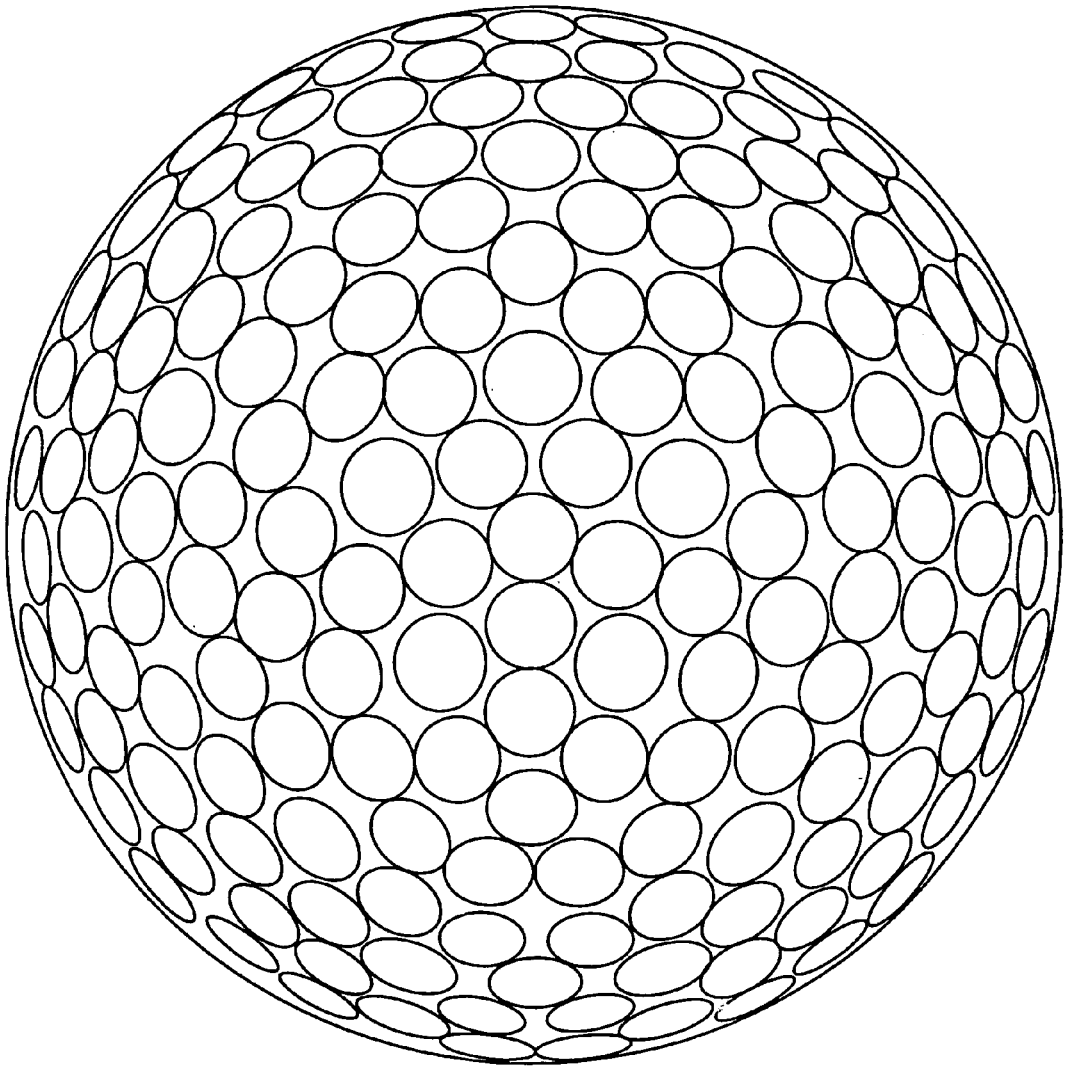
FIG. 5 is a polar view of the ball shown in FIG. 4
Figure 6:
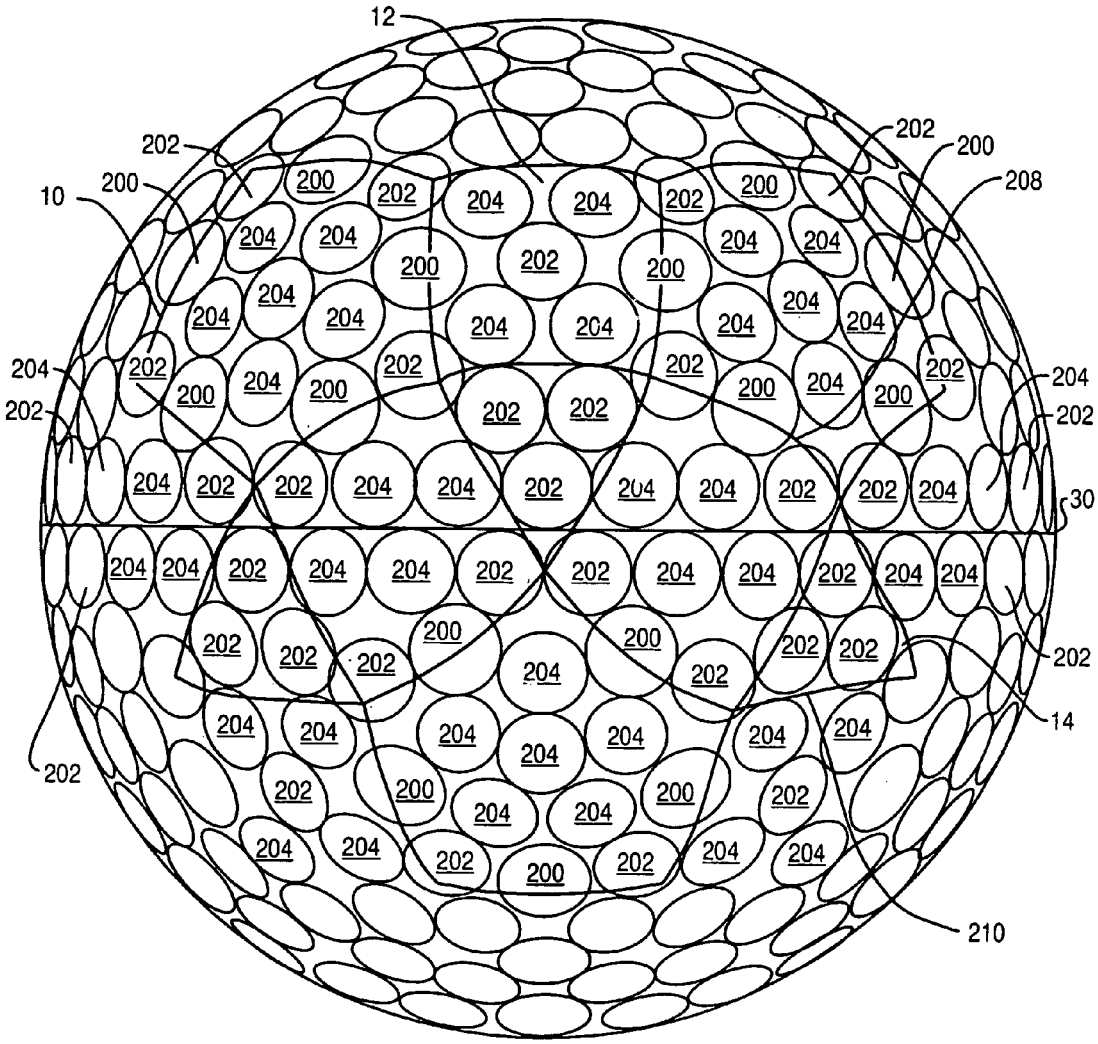
FIG. 6 is an equatorial view of the ball shown in FIG. 4, and includes polygons projected thereon.
Figure 7:
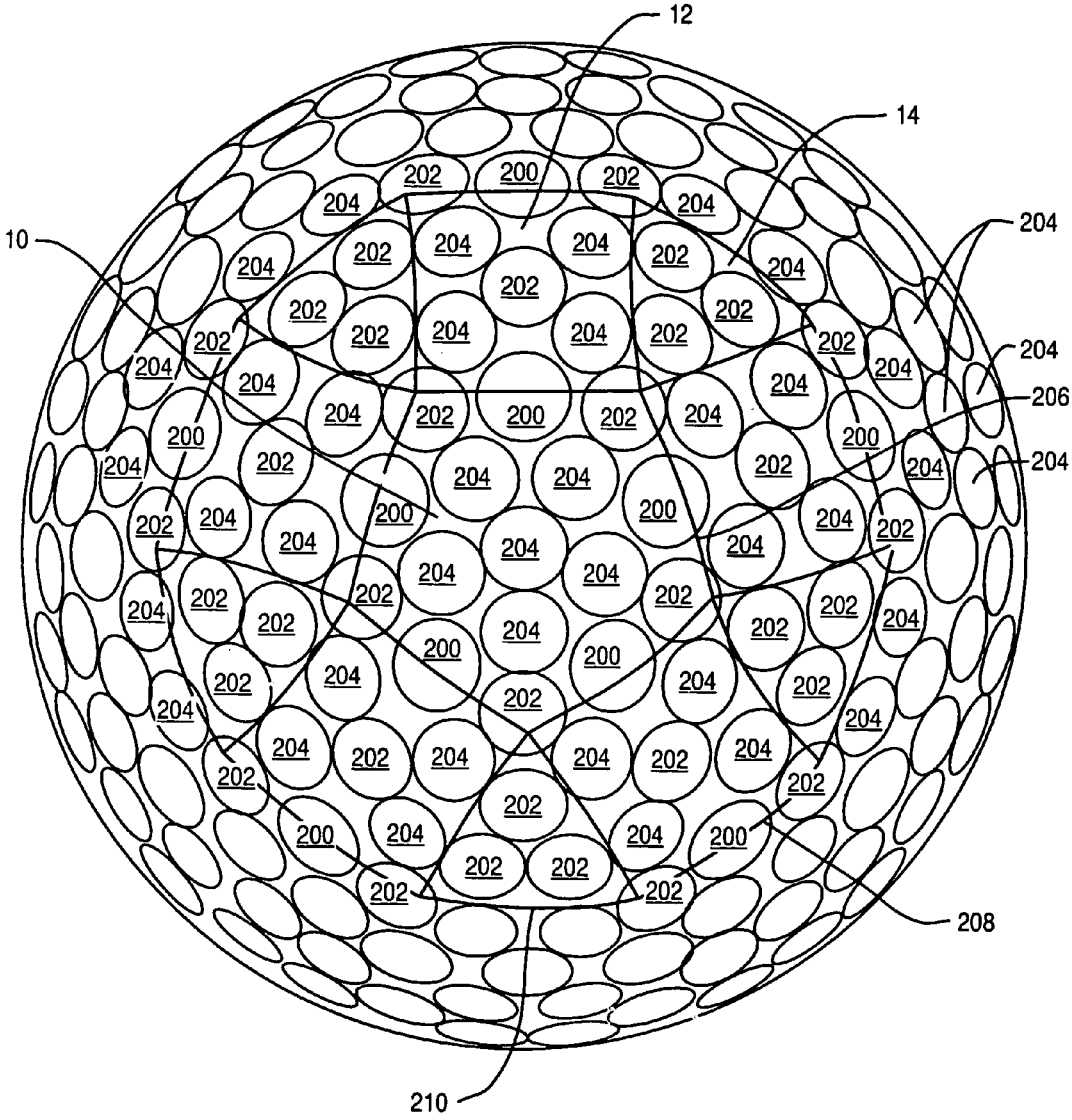
FIG. 7 is a polar view of the ball shown in FIG. 5 and include polygons projected thereon.
Figure 10:
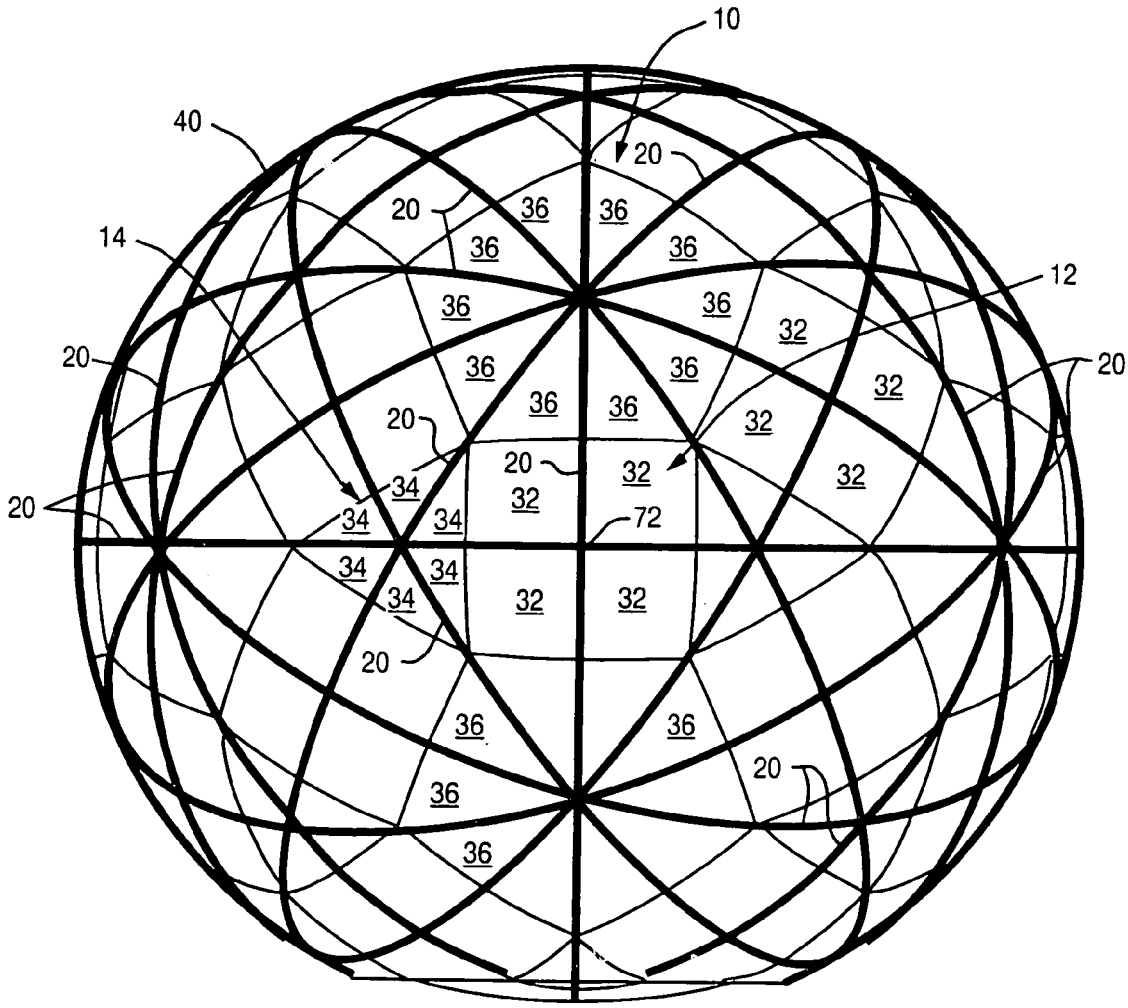
FIG. 10 is an elevation view of the outer surface of the golf ball being further divided by a plurality of parting lines of the polygonal configurations to form another embodiment of the invention.

A secondary partitioning of the outer surface of the golf ball is superimposed on the rhombicosadodecahedron previously described, as illustrated in FIG. 10. For this embodiment the two poles 72 are located at the center of squares and the mold line 40 is formed as illustrated in FIG. 3. This second partitioning is realized by forming parting lines or bisectors 20 along great circle paths that essentially divide each pentagon 10 into ten (10) smaller triangles 36 of equal size. These parting lines 20 also divide each square into four (4) smaller squares 32 and each triangle 14 into six smaller triangles 34. This further division of the outer surface of the golf ball allows the location of dimples over a greatly expanded number of polygonal configurations. It further allows a mold line 40 to be selected to correspond with any one of the parting lines 20 to create a true mold line and fourteen false mold lines.

Figure 11:
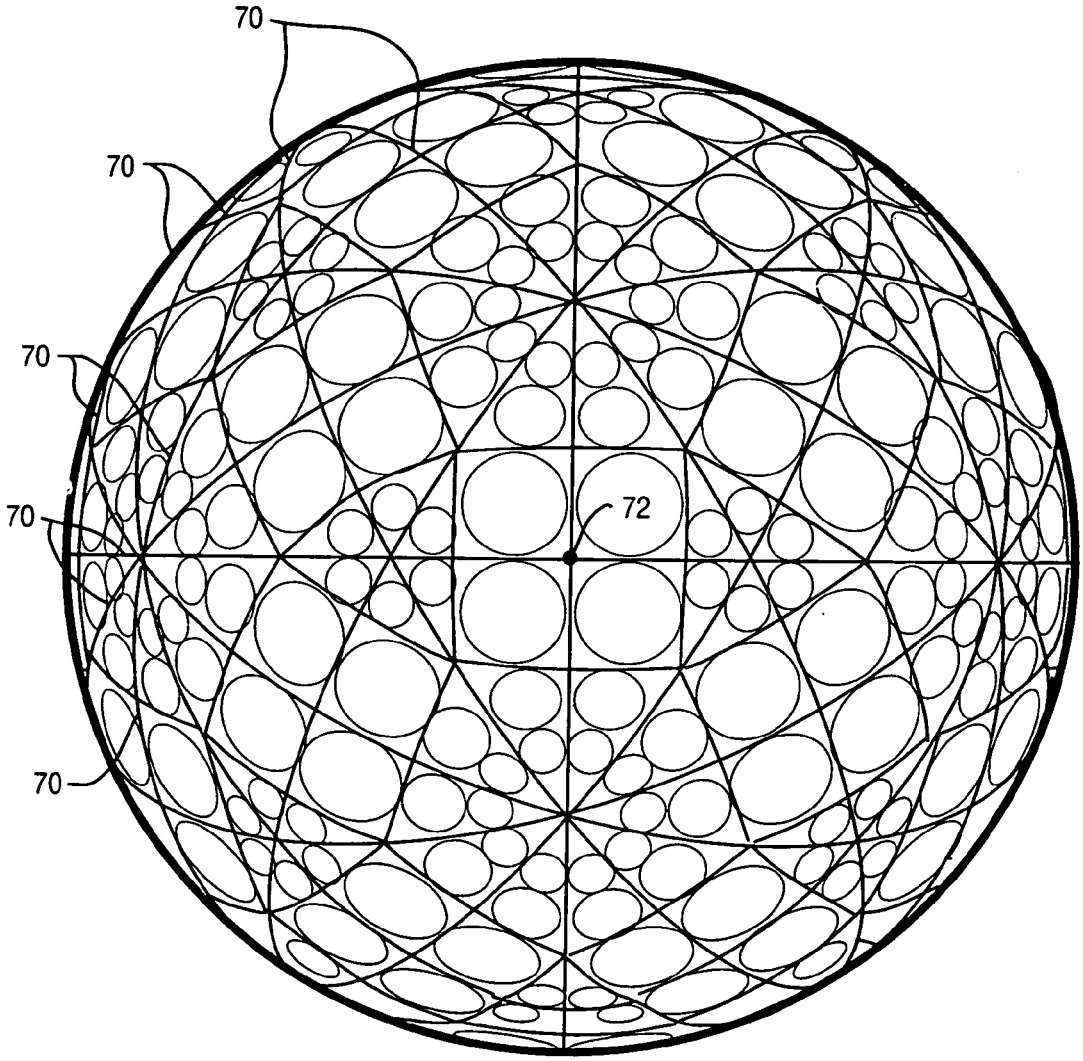
FIG. 11 is an elevation view of the golf ball showing dimples located on the outer surface of the golf ball to correspond with the polygonal configurations and parting lines of FIG. 10.

A possible dimple pattern for the polygonal configuration of FIG. 10 is illustrated in FIG. 11. For this embodiment the dimples are located within all fifteen of the parting lines 70. That is, none of the parting lines are intersected by any dimple. Three different dimple sizes are shown in FIG. 11; with the largest sized dimples located within the squares. This arrangement of dimples is illustrative of having no dimples intersect parting lines. The number of dimples in each of the smaller triangles and squares can be substantially different from the number shown, within the scope of this invention. Dimples are, once again, formed and measured as illustrated in FIG. 16.

Figure 12:
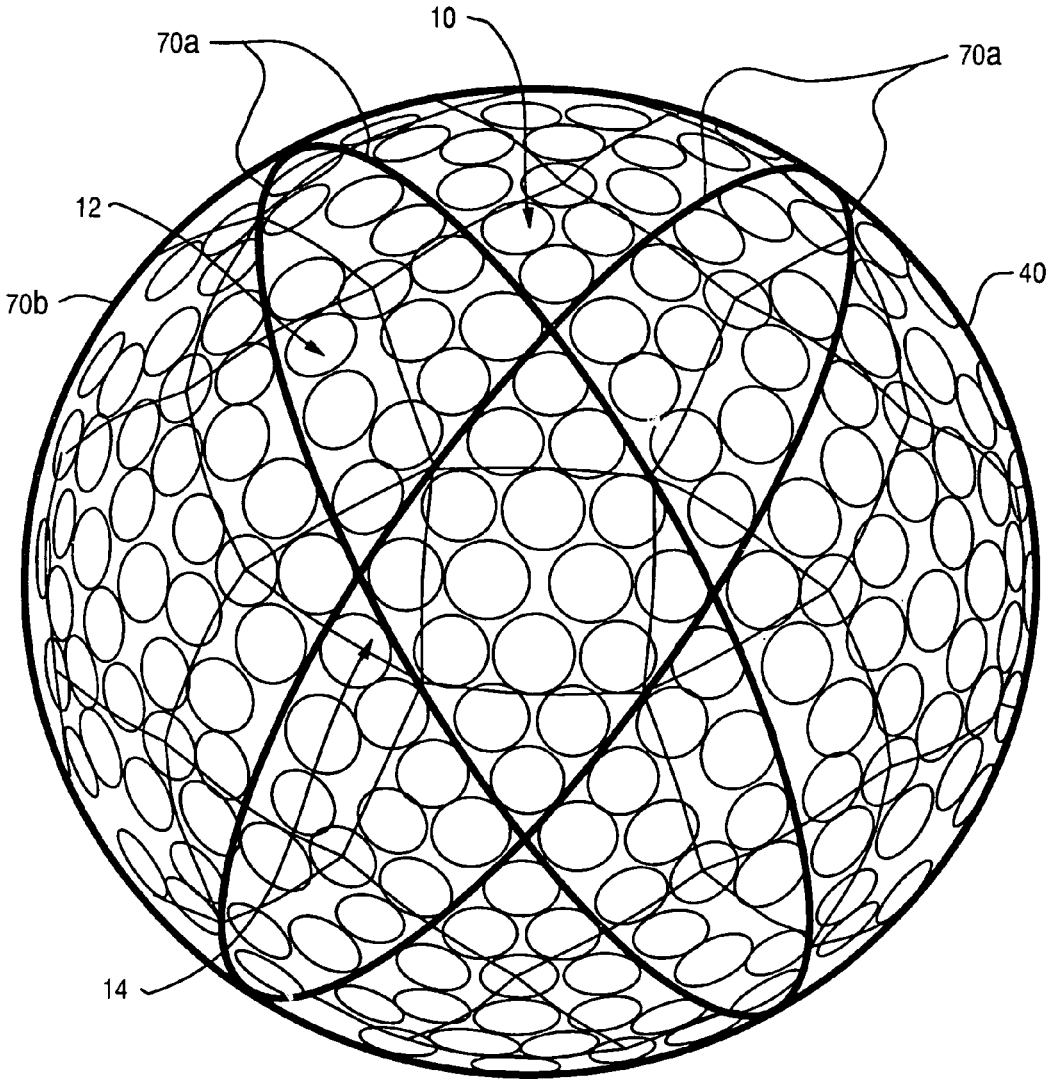
FIG. 12 is an elevation view of the golf ball showing dimples associated with five parting lines on the outer surface of the golf ball to correspond with the polygonal configurations and parting lines of FIG. 2.
Figure 13:
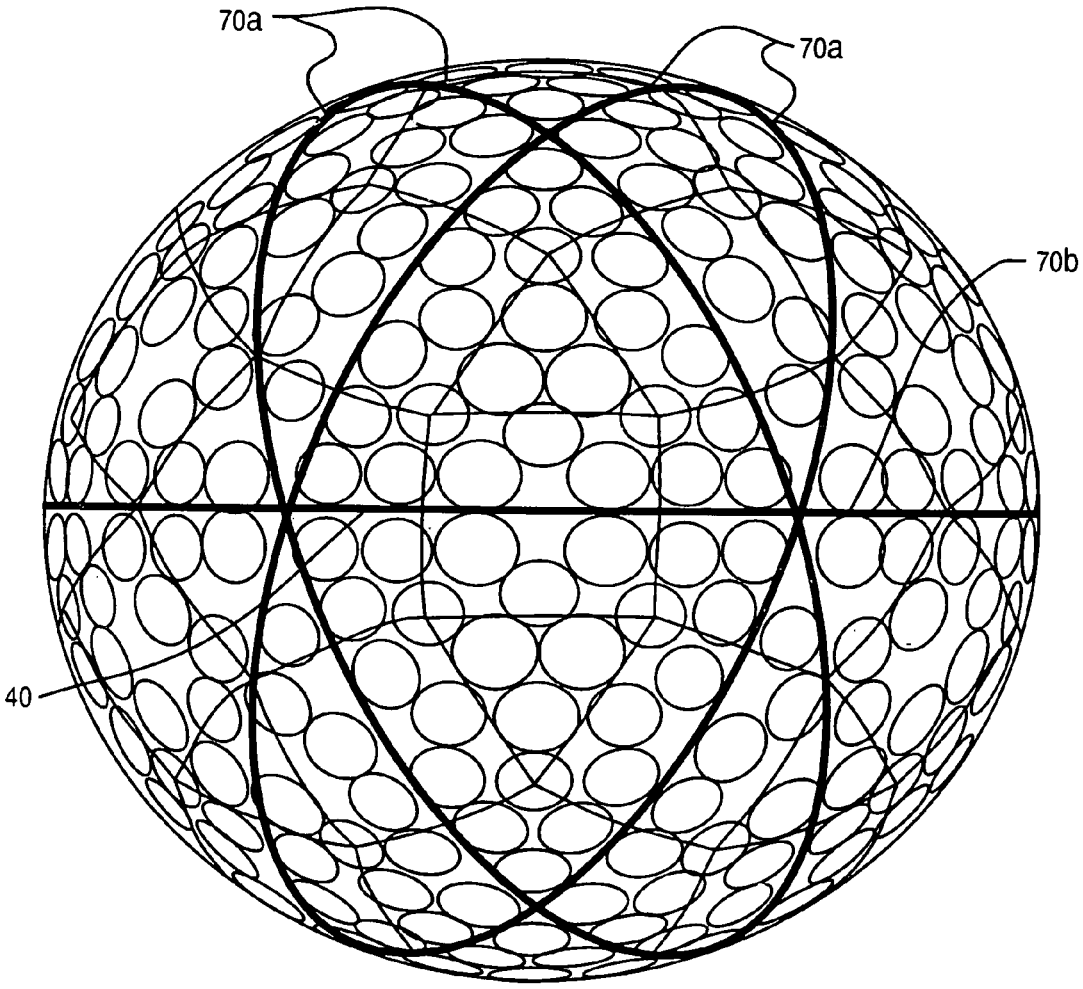
FIG. 13 is an elevation view of the golf ball of FIG. 12 rotated to show an equatorial great circle path defining a mold line.

Another embodiment of the polygonal configurations including certain parting lines is illustrated in FIG. 12. This embodiment uses only five parting lines 70*a* and 70*b* of the fifteen parting lines 20 illustrated in FIG. 10 These certain parting lines are not intersected by any dimples. The mold parting line corresponds to one great circle path 70*b*, as illustrated in the rotated view of the golf ball of FIG. 13. The dimple layout in parts of the outer surface adjacent the five great circle paths may be substantially different than the dimple layout in parts of the outer surface not adjacent the five great circle paths. One example of a dimple layout having dimples approximately equal in size is illustrated in FIGS. 12 and 13.

Figure 14:
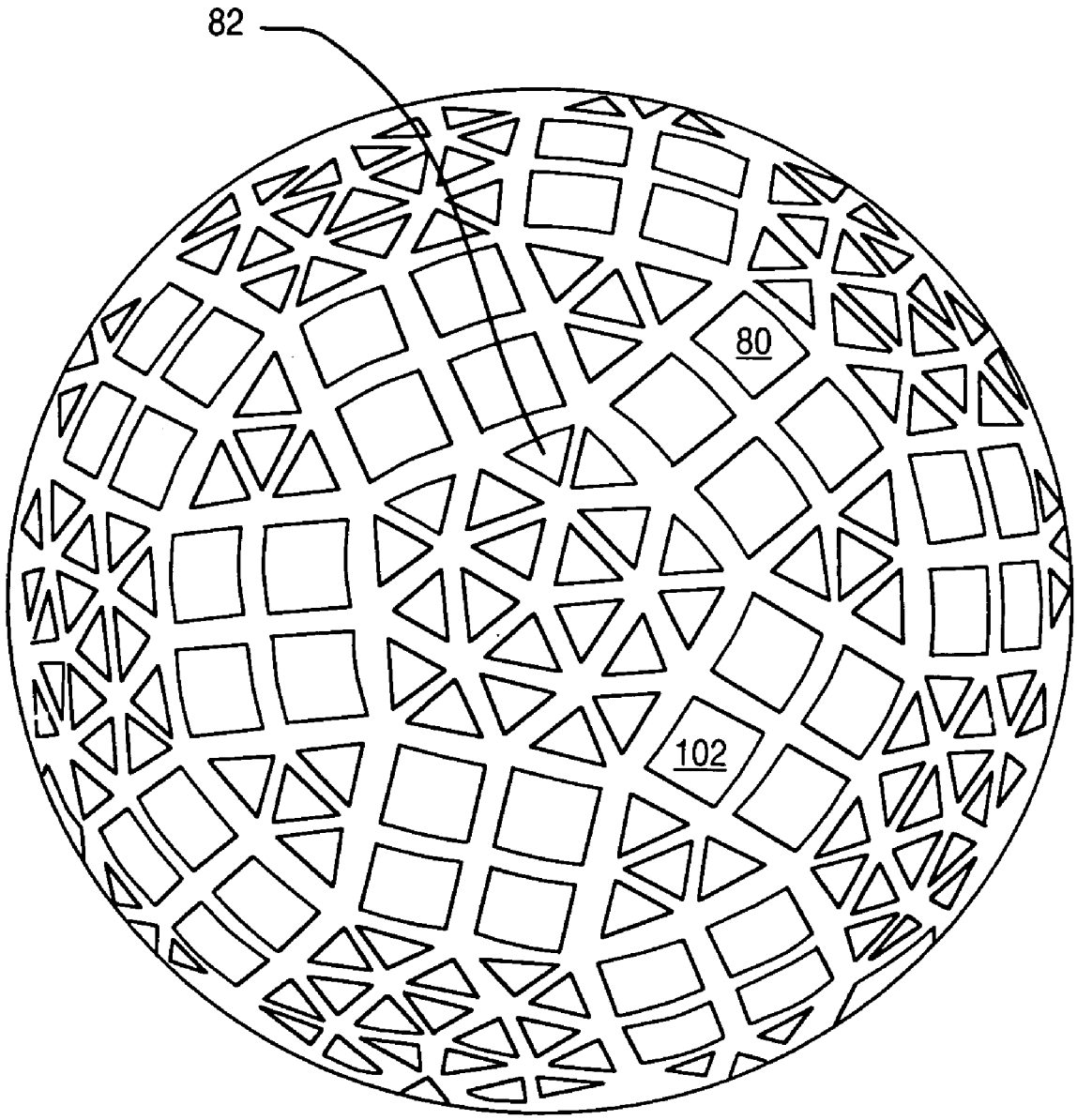
FIG. 14 is an elevation view of the golf ball showing non-circular dimples, being triangles and squares, located on the outer surface of the golf ball to correspond with the polygonal configurations of FIG. 2.
Figure 15:
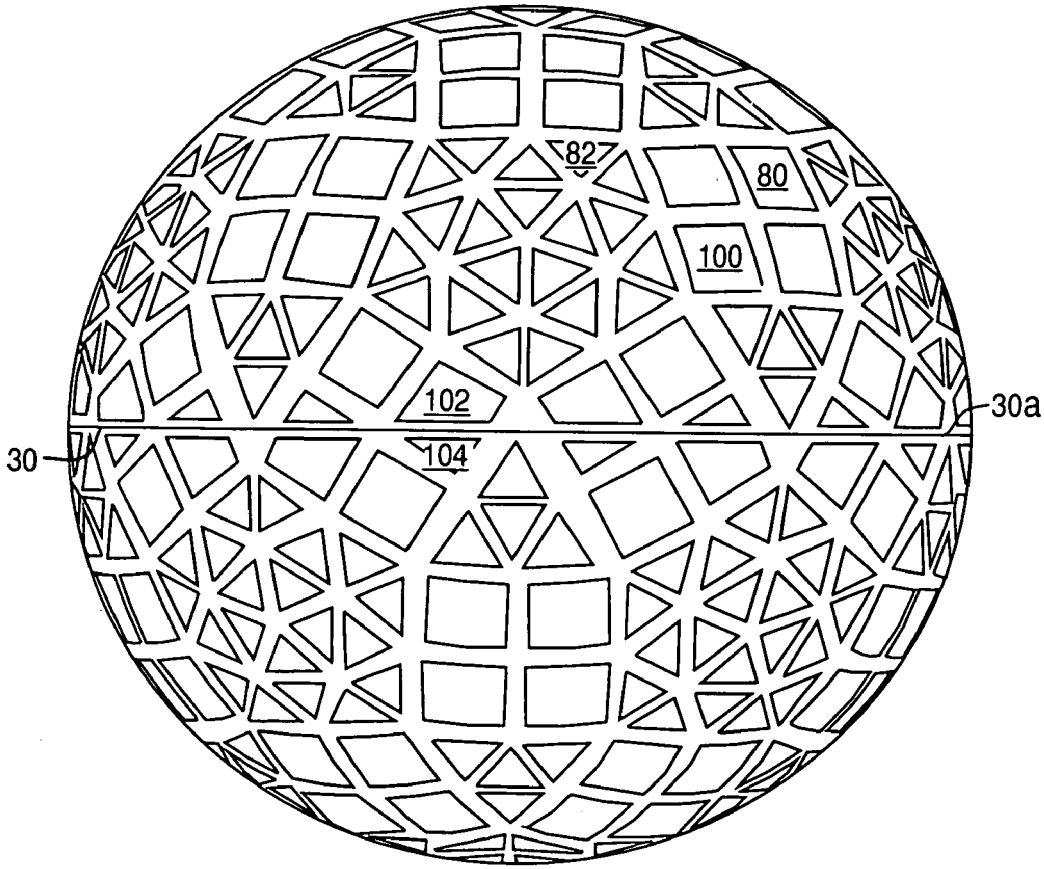
FIG. 15 is an elevation view of the golf ball of FIG. 14 rotated to show an equatorial great circle path defining a mold line.

The previous embodiments illustrate dimples which are formed as generally circular in a plan view of each dimple. Other embodiments of the present invention include dimples which are non-circular in form, as illustrated in FIGS. 14 and 15. These illustrations show the use of the polygonal configurations of FIG. 2; where the pentagons 10 have twenty (20) triangular shaped dimples, the squares 12 have four square shaped dimples and the triangles 14 have four triangular shaped dimples. The triangular shaped dimples have a height in the range of 0.037 inches to 0.149 inches, and a base in the range of 0.037 inches to 0.149 inches. The squared shaped dimples have a height in the range of 0.037 inches to 0.224 inches and a width in the range of 0.037 inches to 0.224 inches.

Dimples at the equatorial great circle path defining a mold parting line 30 are divided into two parts, as illustrated in FIG. 9. Each one of the parts appears in a single one of the polygonal configurations. For the embodiment illustrated, the mold line divides certain square shaped dimples 100 within the squares 12 into two parts 102 and 104. A mold parting surface 30*a* is formed by partially eliminating the depression of the certain square shaped dimples adjacent to the mold parting line without changing the general shape or location of these dimples. For example, the two parts 102 and 104 of a parted square dimple are essentially the same size and shape as the square dimple 100. The mold parting surface becomes bounded by parted dimples. The irregular shaped dimples are measured on the basis of spherical shaped dimples having equivalent surface areas and cross sectional areas as set forth above.

The dimples may be placed on the outer surface of the golf ball to intersect all of the parting lines constructed on the outer surface, none of the parting lines, or only some of the parting lines on the outer surface. When great circle paths are not intersected by dimples they become true parting lines for defining the dimple pattern.

FIG. 8 shows all of the parting lines intersected by dimples; FIG. 11 shows none of the parting lines intersected by dimples; and FIG. 12 shows ten of the parting lines intersected by dimples.

While a preferred embodiment of the invention has been described using specific terms, such description is for illustrative purposes only, and it is to be understood that changes and variations may be made without departing from the spirit or scope of the following claims. For example, it is understood that the invention is not limited to a dimple pattern defined by the rhombicosadodecahedron.

What is claimed is:

1. A golf ball comprising:

an outer surface; and, a plurality of dimples arranged on the outer surface to form a dimple pattern, the plurality of dimples including a first set of dimples, with each dimple in the first set having a single radius cross section and a depth;

a second set of dimples, with each dimple in the second set having a dual radius cross section that comprises a minor radius, a major radius and a depth; and, a third set of dimples, with each dimple in the third set having a single radius cross section and a depth.

2. The golf ball of claim 1 further comprising:

a core, wherein said core is selected from the group consisting of one piece solid cores, wound cores with solid centers, multilayered cores, and wound cores with liquid filled centers.

3. The golf ball of claim 1 wherein the depth of the dimples in the first set of dimples, the second set of dimples, and the third set of dimples is 0.0056 inches to 0.0078 inches.

4. The golf ball of claim 1 wherein the outer surface is divided by five great circle paths free of dimples, wherein one of the five great circle paths is a mold parting line.

5. The golf ball of claim 1 wherein the outer surface is divided by fifteen great circle paths free of dimples, wherein one of the fifteen great circle paths is a mold parting line.

6. The golf ball of claim 1 wherein the outer surface is divided into a plurality of polygonal configurations which include pentagons, squares and triangles, wherein a first pattern of dimples is associated with each triangle, a second pattern of dimples is associated with each pentagon, and a third pattern of dimples is associated with each square.

7. The golf ball of claim 1 wherein the dimples in the first set of dimples have a different size than the dimples in the third set of dimples.

8. A golf ball comprising:

an outer surface; and, a plurality of dimples arranged on the outer surface to form a dimple pattern, the plurality of dimples including a first set of dimples, with each dimple in the first set having a single radius cross section and a depth wherein the dimples in the first set of dimples have a diameter of 0.150 inches to 0.160 inches and a major radius of 0.34 inches to 0.80 inches;

a second set of dimples, with each dimple in the second set having a dual radius cross section that comprises a minor radius, a major radius and a depth, wherein the dimples in the second set of dimples have a diameter of 0.14 inches to 0.15 inches, a major radius of 0.34 inches to 0.8 inches, and a minor radius of 0.1 inches to 0.12; and, a third set of dimples, with each dimple in the third set having a single radius cross section and a depth, wherein the dimples in the third set of dimples have a diameter of 0.135 inches to 0.145 inches and a major radius of 0.34 inches to 0.8 inches.

9. The golf ball of claim 8 wherein said outer surface is divided into a polyhedron defined as a rhombicosadodecahedron and dimples are arranged using that pattern.

10. The golf ball of claim 9 wherein the outer surface is divided into a plurality of polygonal configurations which include pentagons, squares and triangles, wherein a first pattern of dimples is associated with each triangle, a second pattern of dimples is associated with each pentagon, and a third pattern of dimples is associated with each square.

11. The golf ball of claim 10 wherein three dimples are associated with each triangle, five dimples are associated with each square, and sixteen dimples are associated with each pentagon.

12. A golf ball comprising:

an outer surface; and, a plurality of dimples arranged on the outer surface to form a dimple pattern wherein said outer surface comprises thirty squares, twelve pentagons, and twenty triangles, and wherein the plurality of dimples are arranged using that pattern, the plurality of dimples including a first set of dimples, with each dimple in the first set having a single radius cross section and a depth;

a second set of dimples, with each dimple in the second set having a dual radius cross section that comprises a minor radius, a major radius and a depth; and, a third set of dimples, with each dimple in the third set having a single radius cross section and a depth.

13. The golf ball of claim 12 wherein each of the pentagons have a common boundary with five of the squares, and each of the pentagons shares its vertices with five of the triangles.

14. The golf ball of claim 12 wherein each of the triangle has a vertice in common with that of three different pentagons.

15. The golf ball of claim 12 wherein a mold parting line on the surface of the golf ball is the only great circle which does not intersect the plurality of dimples.

16. The golf ball of claim 12 wherein the pentagons have dimples associated with it from the first set of dimples and from the third set of dimples.

17. The golf ball of claim 12 wherein all sides of the pentagons intersect dimples from the second set.

18. A golf ball comprising:

an outer surface; and, a plurality of dimples arranged on the outer surface to form a dimple pattern, the plurality of dimples including a first set of dimples, with each dimple in the first set having a single radius cross section and a depth;

a second set of dimples, with each dimple in the second set having a dual radius cross section that comprises a minor radius, a major radius and a depth;

a third set of dimples, with each dimple in the third set having a single radius cross section and a depth; wherein said outer surface is divided into a polyhedron defined as a rhombicosadodecahedron and dimples are arranged using that pattern wherein the rhombicosadodecahedron is further divided by five great circle paths which do not intersect any of the dimples, wherein one of the five great circle paths is a true mold parting line.

19. A golf ball comprising:

an outer surface; and, a plurality of dimples arranged on the outer surface, wherein the surface is divided into a rhombicosadodecahedron pattern that comprises thirty squares, twelve pentagons, and twenty triangles to form a dimple pattern, the plurality of dimples are non-circular in form.

20. The golf ball of claim 19 wherein the non-circular dimples are selected from a group consisting of truncated cones, squares, triangles, dimples within dimples, elliptical surfaces and combinations thereof.

21. The golf ball of claim 19 wherein the non-circular dimples comprises a plurality of triangular dimples, and a plurality of square dimples.

22. The golf ball of claim 21 wherein the triangular dimples are associated with the pentagons and the triangles; and, the square dimples are associated with the squares.

23. The golf ball of claim 22 wherein the triangular dimples have a height of about 0.037 to 0.149 inches and a base of about 0.037 to 0.149 inches; and, the square dimples have a height of about 0.037 inches to 0.224 inches and a width of about 0.037 to 0.224 inches.

24. The golf ball of claim 19 wherein five great circles further divide the outer surface and the great circle that coincides with the mold parting line does not intersect any of the dimples.

25. The golf ball of claim 19 wherein the outer surface is divided by fifteen great circles and fourteen of the great circles intersects the dimples.

26. The golf ball of claim 19 wherein the outer surface is divided by fifteen great circles that does not intersect any of the dimples.

* * * * *